US008545055B2

(12) United States Patent
Chang

(10) Patent No.: US 8,545,055 B2
(45) Date of Patent: Oct. 1, 2013

(54) LED LAMP WITH ADJUSTABLE LIGHT FIELD

(75) Inventor: Kuo-Cheng Chang, Miao-Li (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 205 days.

(21) Appl. No.: 13/274,362

(22) Filed: Oct. 17, 2011

(65) Prior Publication Data

US 2012/0106154 A1 May 3, 2012

(51) Int. Cl.
*F21V 3/00* (2006.01)

(52) U.S. Cl.
USPC ..... 362/249.03; 362/249.11; 362/368

(58) Field of Classification Search
USPC ..... 362/249.03, 249.11, 318
See application file for complete search history.

(56) References Cited

U.S. PATENT DOCUMENTS

| | | | | |
|---|---|---|---|---|
| 4,389,699 | A * | 6/1983 | Qualls | 362/217.05 |
| 6,881,946 | B2 * | 4/2005 | Cok et al. | 250/208.6 |
| 7,097,322 | B2 * | 8/2006 | Shuniak | 362/199 |
| 7,766,505 | B2 * | 8/2010 | Tseng et al. | 362/217.17 |
| 2009/0190350 | A1 * | 7/2009 | Tseng et al. | 362/249.01 |

* cited by examiner

*Primary Examiner* — Ali Alavi
(74) *Attorney, Agent, or Firm* — Altis & Wispro Law Group, Inc.

(57) ABSTRACT

An LED lamp includes a holder with a base, a first light module and a second light module. The first light module includes a first light cover and a first set of LEDs. The first light cover has a hollow conical configuration with a wide top end tapering to a small bottom end. The small bottom end of the first light cover is connected to the base. The first set of LEDs is received in a hollow space of the first light cover. The second light module includes a second light cover and a second set of LEDs received in the second light cover. The second light cover is capable of rotating relative to the first light module.

20 Claims, 4 Drawing Sheets

LED LAMP WITH ADJUSTABLE LIGHT FIELD

BACKGROUND

1. Technical Field

The present disclosure generally relates to light emitting diode (LED) lamps, and particular to an LED lamp with adjustable light field.

2. Description of Related Art

With the continuing development of scientific technology and the raise of people's consciousness of energy saving, LEDs have been widely used in the field of lamp due to their small size and high efficiency. In the design of an LED lamp, light field is always one of major concerns. Most LED lamps generally generate butterfly-type light fields or diffusion-type light fields. However, these types of light field are unchangeable, and not always suitable for a particular application.

Therefore, it is necessary to provide an LED lamp whose light field is adjustable.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure.

DETAILED DESCRIPTION

Reference will now be made to the drawings to describe the present LED lamp, in detail.

Figure 1:
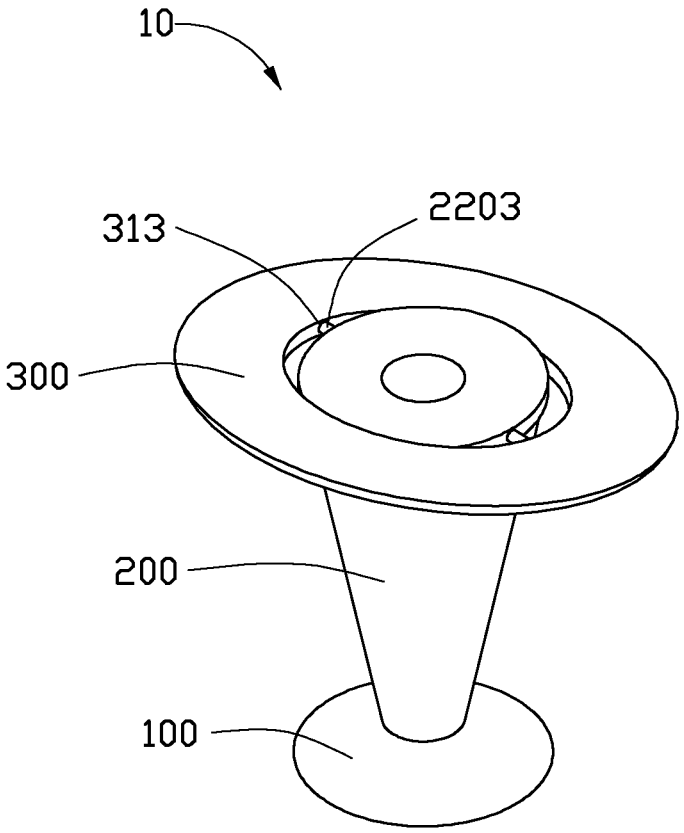
FIG. 1 is a perspective view of an LED lamp in accordance with the present disclosure.

Referring to FIG. 1, an LED lamp 10 according to an exemplary embodiment includes a holder 100, a first light module 200 and a second light module 300. The first light module 200 is arranged on the holder 100, and the second light module 300 is arranged around a top of the first light module 200.

Figure 2:
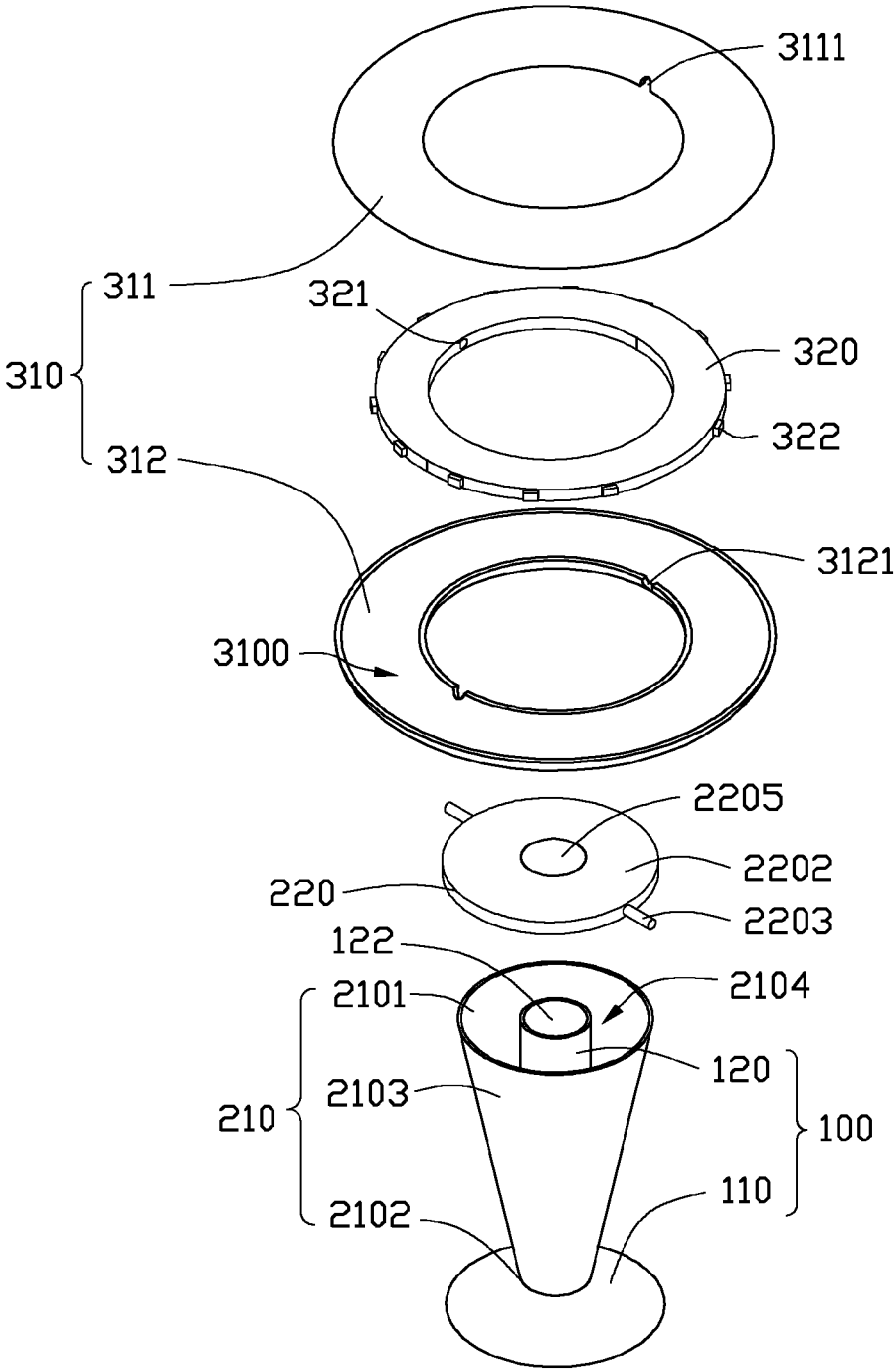
FIG. 2 is an exploded view of the LED lamp of FIG. 1.
Figure 3:
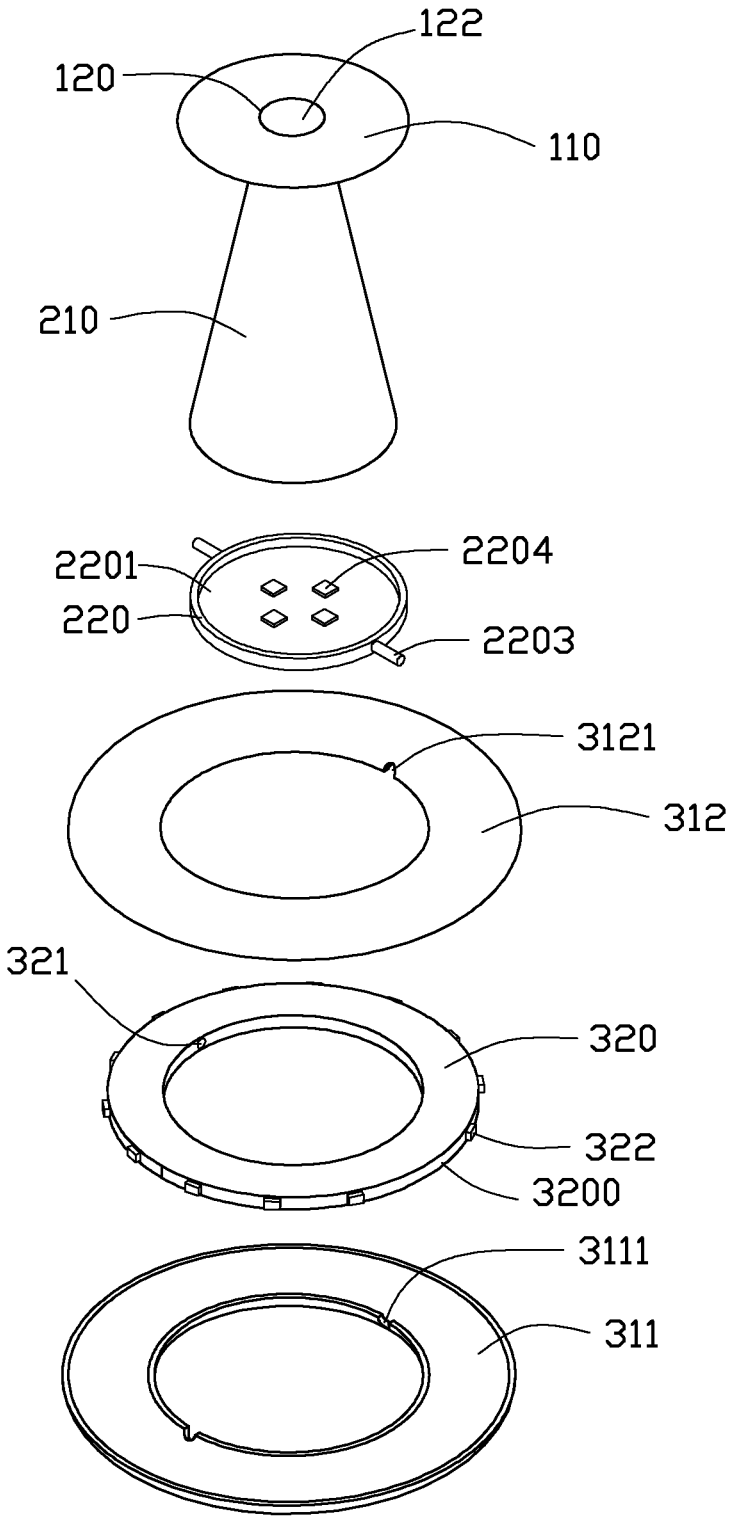
FIG. 3 is similar to FIG. 2, but showing another aspect of the LED lamp.
Figure 4:
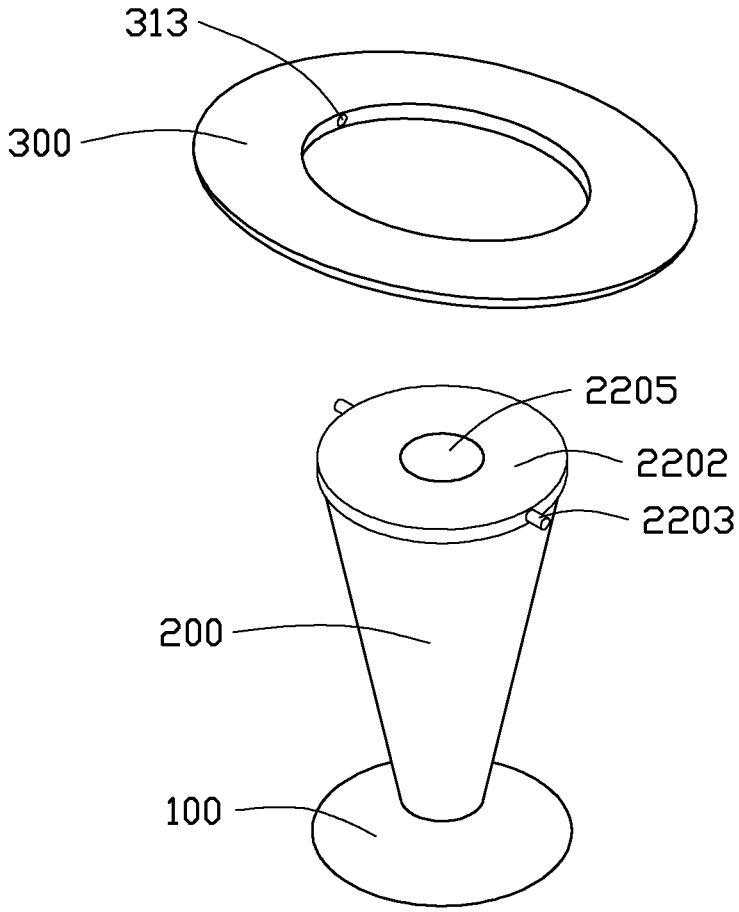
FIG. 4 is similar to FIG. 1, but showing a second light module separated from the LED lamp.

Also referring to FIG. 2 and FIG. 3, the holder 100 includes a base 110 and a supporter 120. The base 110 has a round shape for supporting the first light module 200. The supporter 120 has a hollow cylindrical configuration with a longitudinal passage 122 defined therein. The supporter 120 is connected to the base 110 by a bottom end thereof, and penetrates through the base 110 with the longitudinal passage 122 exposed outside.

The first light module 200 includes first light cover 210 and a lid 220.

The first light cover 210 has a hollow conical configuration tapering from an upper wide opening end 2101 to a bottom small opening end 2102. The small opening end 2102 of the first light cover 210 is connected to the base 110. The base 110 covers and seals the small opening end 2102. The supporter 120 is received in a hollow space 2104 of the first light cover 210. The first light cover 210 is made of light transmissive material. In addition, an outer side surface 2103 of the first light cover 210 can further be coated with light scattering material.

The lid 220 is a round plate with a diameter the same as that of the wide opening end 2102 of the first light cover 210. The lid 220 is arranged at an upper side of the first light cover 210, and seals the wide opening end 2120. The lid 220 includes a bottom surface 2201, a top surface 2202 and two round shaft-shaped electrodes 2203.

The bottom surface 2201 faces the hollow space 2104 and contacts the supporter 120. Thereby the supporter 112 supports the bottom surface 2201 of the lid 220. The bottom surface 2201 has a plurality of first LEDs 2204 arranged thereon. In this embodiment, the first LEDs 2204 surround a center of the bottom surface 2201. The first LEDs 2204 can be connected to an external power supply (not illustrated) by wires extending through the longitudinal passage 122 of the supporter 120.

The top surface 2202 has a recess 2205 defined therein. The recess 2205 can be used to receive and hold a container, for example a cup. In this embodiment, the lid 220 is made of thermally conductive material. As such, the lid 220 is capable of transferring heat generated by the first LEDs 2204 to the container received in the recess 2205, thereby performing a function to keep warmth of the content in the cup, which can be drink such as coffee or tea. In addition, the recess 2205 can also be used to retain incenses capable of producing a pleasant odor when heated.

The two round shaft-shaped electrodes 2203 extend from a peripheral edge of the lid 220. The two electrodes 2203 are symmetric to each other relative to a center of the lid 220.

The second light module 300 includes a hollow second light cover 310, a substrate 320, and a plurality of second LEDs 322.

The second light cover 310 has an annular configuration. In this embodiment, the second light cover 310 includes an upper portion 311 and a bottom portion 312. The upper portion 311 and bottom portion 312 each have an annular configuration with a recessed profile. As such, when engaged together, the upper portion 311 and bottom portion 312 cooperatively form an annular space 3100 receiving the second light cover 310 therein.

The upper portion 311 includes two notches 3111 defined at an inner edge thereof. The two notches 3111 are symmetric to each other relative to a center of the annular upper portion 311. In this embodiment, the two notches 3111 each have a semicircular shape. The upper portion 311 can be made of opaque or transparent material. In addition, the upper portion 311 can further be coated with light scattering material when it is made of light transmissive material.

The bottom portion 312 includes two notches 3121 defined at an inner edge thereof. The two notches 3121 each correspond to a notch 3111 of the upper portion 311. When the upper portion 311 and the bottom portion 312 are engaged together, the notches 3111, 3121 cooperatively forms two through holes 313 penetrating a sidewall of an inner circle of the annular second light cover 310. In this embodiment, the two notches 3121 each have a semicircular shape. As such, the through hole 313 cooperatively formed by the notches 3111 and 3121 is round. The bottom portion 312 is made of light transmissive material, thereby enabling light emitted from the plurality of second LEDs 322 to radiate therethrough. In addition, the bottom portion 312 can be coated with light scattering material to scatter light to various directions. Thus, a uniform light can be obtained The substrate 320 is received in the annular space 3100 of the second light cover 310. The substrate 320 also has an annular shape. The substrate 320 includes two pivoting holes 321 defined in a circular edge of an inner circle of the annular substrate 320. The two pivoting holes 321 are respectively corresponding to the two through holes 313 of the second light cover 310. The two electrodes 2203 extend into the pivoting holes 321 via the through holes 313 of the second light cover 310. As such, the lid 220 is pivotably connected to the second light cover 310 by the two electrodes 2203, and the second light cover 310 is capable of rotating about an axis formed by the two electrodes 2203.

The plurality of second LEDs 322 is arranged on a peripheral sidewall 3200 of the substrate 320 and is received in the annular space 3100 of the second light cover 310. The second LEDs 322 can be electrically connected to an external power supply (not illustrated) by the two electrodes 2203 and the wires extending through the longitudinal passage 122 of the supporter 120. The bottom portion 312 outputs light emitted from the plurality of second LEDs 322. In addition, the plurality of second LEDs 322 can also be arranged on a top or a bottom surface of the substrate 320.

Due to that the second light cover 310 of the second light module 300 is capable of rotating relative to the electrodes 2203 of the first light module 200, a light field of the LED lamp 100 can be adjusted according to a particular requirement.

It is to be understood that the above-described embodiments are intended to illustrate rather than limit the disclosure. Variations may be made to the embodiments without departing from the spirit of the disclosure as claimed. The above-described embodiments illustrate the scope of the disclosure but do not restrict the scope of the disclosure.

What is claimed is:

1. An LED lamp comprising:

a holder comprising a base;

a first light module comprising a first light cover and a first set of LEDs, the first light cover having a hollow conical configuration and tapering from a wide top end to a small bottom end, the small bottom end of the first light cover being connected to the base, the first set of LEDs being received in a hollow space of the first light cover; and a second light module comprising a second light cover and a second set of LEDs received in the second light cover, the second light cover being rotatablely connected to the first light module.

2. The LED lamp according claim 1, wherein the holder further comprises a cylindrical supporter received in the hollow space of the first light cover, the supporter being connected to and penetrating through the base.

3. The LED lamp according claim 2, wherein the wide top end of the first light cover is open, the first light module further comprising a lid sealing the wide top end of the first light cover, the lid being supported by the cylindrical supporter.

4. The LED lamp according claim 3, wherein the lid comprises a bottom surface facing the hollow space of the first light cover, the first set of LEDs being arranged on the bottom surface of the lid, the cylindrical supporter contacting and supporting the bottom surface of the lid.

5. The LED lamp according claim 4, wherein the lid further comprises two round shaft-shaped electrodes extending from a peripheral edge thereof, the two electrodes being symmetric to each other relative to a center of the lid, the lid being pivotably connected to the second light cover by the two electrodes.

6. The LED lamp according claim 5, wherein two through holes are defined in a sidewall of an inner circle of the annular second light cover, the two electrodes of the lid respectively extending into the two through holes.

7. The LED lamp according claim 6, wherein the second light module further comprises an annular substrate received in the hollow space of the second light cover, the second set of LEDs being arranged on the annular substrate.

8. The LED lamp according claim 7, wherein two pivoting holes are defined on a circular edge of an inner circle of the annular substrate, the two cylinder electrodes of the lid respectively extending into the two pivoting holes via the two through holes of the second light cover.

9. The LED lamp according claim 5, wherein the second light module is capable of rotating about an axis formed by the two electrodes.

10. The LED lamp according claim 6, wherein the second light cover includes an annular upper portion and an annular bottom annular portion, the upper portion and the bottom portion cooperatively forming the hollow space of the second light cover, the upper portion comprising a pair of notches defined at an inner edge thereof, the bottom portion comprising a pair of notches defined at an inner edge thereof and each corresponding to a respective notch of the upper portion, each of the through holes is cooperatively formed by two corresponding notches respectively defined on the upper and bottom portions of the second light cover.

11. The LED lamp according claim 10, wherein the bottom portion is made of light transmissive material.

12. The LED lamp according claim 11, wherein the bottom portion is coated with light scattering material.

13. The LED lamp according claim 12, wherein the upper portion is made of light blocking material.

14. The LED lamp according claim 12, wherein the upper portion is made of light transmissive material, and coated with light scattering material.

15. The LED lamp according claim 12, wherein the first light cover is made of light transmissive material, and an outer side surface of the first light cover is coated with light scattering materials.

16. An LED lamp comprising:

a base;

a first light module comprising a first light cover arranged on the base and a first set of LEDs received in the first light cover; and a second light module comprising a second light cover being rotatablely connected to the first light cover and a second set of LEDs received in the second light cover.

17. The LED lamp according claim 16, wherein one of the first and second light covers defines two slots therein, and the other one of the first and second light covers having two poles extending outwards to be rotatably engaged in the slots.

18. The LED lamp according claim 17, wherein the first light cover comprises a hollow body arranged on the base and a lid arranged on the hollow body, the two poles extending outwards from a periphery of the lid, the second light cover defining the two slots.

19. The LED lamp according claim 18, wherein the first set of LEDs is fixed on the lid.

20. The LED lamp according claim 18, further comprising a supporter extending up from the base, the supporting being received in the hollow body and supporting the lid thereon.

* * * * *